US005123232A

United States Patent [19]

Helms et al.

[11] Patent Number: 5,123,232

[45] Date of Patent: Jun. 23, 1992

[54] APPARATUS FOR FILLING BAGS WITH UNWIELDY GOODS

[75] Inventors: Bernd Helms, Sharrieshoop; Reiner Peters, Ellerhoop; Peter Hoppe, Sparrieshoop, all of Fed. Rep. of Germany

[73] Assignee: W. Kordes' Sohne Rosenschulen GmbH & Co KG, Sparrieshoop, Fed. Rep. of Germany

[21] Appl. No.: 585,144

[22] PCT Filed: Feb. 9, 1990

[86] PCT No.: PCT/EP90/00217

§ 371 Date: Oct. 4, 1990

§ 102(e) Date: Oct. 4, 1990

[87] PCT Pub. No.: WO90/09318

PCT Pub. Date: Aug. 23, 1990

[30] Foreign Application Priority Data

Feb. 10, 1989 [DE] Fed. Rep. of Germany ..... 3904043

[51] Int. Cl.[5] ..... B65B 43/26

[52] U.S. Cl. ..... 53/570; 53/255; 53/258

[58] Field of Search ..... 141/166; 53/570, 571, 53/170, 245, 255, 258, 260, 261

[56] References Cited

U.S. PATENT DOCUMENTS

| | | | |
|---|---|---|---|
| 3,091,903 | 6/1963 | Kammerer | 53/260 |
| 3,143,836 | 8/1964 | Weller . | |
| 3,503,180 | 3/1970 | Myles et al. | 53/258 |
| 3,643,401 | 2/1972 | Wickersheim | 53/258 X |
| 3,746,057 | 7/1973 | Titchenal | 53/570 X |
| 3,812,642 | 5/1974 | Mintz et al. | 53/258 X |
| 4,203,269 | 5/1980 | Petersen | 53/525 X |
| 4,271,877 | 6/1981 | Whitaker et al. | 141/166 |
| 4,514,962 | 5/1985 | Ausnit | 53/570 X |
| 4,541,228 | 9/1985 | Petersen | 53/255 X |
| 4,590,747 | 4/1986 | Schjeldahl | 53/258 X |
| 4,671,044 | 6/1987 | An | 53/570 X |
| 4,706,440 | 11/1987 | Bittner | 53/258 X |
| 4,864,800 | 9/1989 | Banys et al. | 53/260 X |
| 5,020,301 | 6/1991 | Helms . | |

FOREIGN PATENT DOCUMENTS

| | | | |
|---|---|---|---|
| 6926951 | 7/1969 | Fed. Rep. of Germany . | |
| 2538513 | 8/1975 | Fed. Rep. of Germany . | |
| 88048535 | 7/1988 | Fed. Rep. of Germany . | |
| 2331483 | 6/1977 | France | 53/258 |
| 2014104 | 8/1979 | United Kingdom . | |

*Primary Examiner*—Robert L. Spruill
*Assistant Examiner*—Daniel B. Moon
*Attorney, Agent, or Firm*—Brumbauh, Graves, Donohue & Raymond

[57] ABSTRACT

An upright immersion tube (92) is movable back and forth in its longitudinal direction between a takeover position in which a bushy plant (10) can be introduced into the immersion tube (92) and an immersed position in which the immersion tube is plunged through a spreader tube (40) into the vicinity of the bottom of a bag (12) which is being held open. The immersion tube (92) has a rear semi-tubular portion (96) with a hinged flap which is open in the takeover position but adapted to be moved into a closing position as the immersion tube (92) moves into the immersed position and, in said closing position, supplements the rear portion (96) so as to form a closed tube section. The spreader tube (40) has the profile contour of a ship's hull and engages between projecting bag edge zones (16) of a film web forming the bags (12) and being movable stepwise in the longitudinal direction of this contour. The flap is a semi-tubular portion of the imemrsion tube (92) and, with the conveyor chute (98) in the open position, it aligns one bushy plant (10) each in longitudinal direction of the immersion tube (92), with the root conglomerate leading.

4 Claims, 4 Drawing Sheets

APPARATUS FOR FILLING BAGS WITH UNWIELDY GOODS

BACKGROUND OF THE INVENTION

The invention relates to an apparatus for filling bags with unwieldy goods, comprising a spreader means to hold open a bag, a channel which is movable back and forth in its own longitudinal direction between a takeover position in which goods to be filled can be introduced into the channel and an immersed position in which it is plunged through the spreader means all the way into the vicinity of the bottom of the bag which is being held open, the channel comprising a hinged flap which is open in the takeover position but adapted to be moved into a closing position in which it supplements the channel to form a closed tube portion when the channel moves into the immersed position.

Such an apparatus is known from U.S. Pat. No. 4,203,269. With this known apparatus the channel is a horizontal, upwardly open groove which carries a pair of horizontal bearing pins near its front end to support the flap. In the takeover position the front end area of the channel is positioned under a funnel and the flap is almost in a vertical position, its lower part closing the front end of the channel and its upper part protruding into the funnel so that the goods to be filled can fall into the channel but cannot leave it as yet at the front end thereof. The spreader means comprises a nozzle through which air is introduced respectively into a bag which is retained in front of the channel so as to keep it open while the channel is moved into the same. A piston and cylinder arrangement is associated with the channel for its horizontal reciprocating motion. Another piston and cylinder arrangement effects reciprocating movements of a piston-like pusher member in the channel so as to push the goods to be filled toward the front out of the channel when the latter is plunged into the bag.

This known apparatus is suitable for bulk material which is only moderately unwieldy, like carrots. The known apparatus at any rate is not suited for the automatic packing of plants in the form of bushes or shrubs which do not readily orient themselves in longitudinal direction of the horizontal, upwardly open channel if the cross section of the channel and thus also of the bags to be filled is not much larger than the greatest cross section of the conglomerate of roots of the bushy plants. If the bushy plants were packed in correspondingly large bags, their conglomerates of roots would be insufficiently protected against drying out.

Furthermore, an apparatus for packing bushy plants is known from U.S. Pat. No. 3,143,836, comprising a bed, ready for one bushy plant each to be placed on it, below a funnel for feeding bushy plants, and a pair of molding jaws between which the bushy plant is compressible such that subsequently it can be pushed by means of a pusher member transversely of the direction of movement of the two molding jaws through a mouthpiece into a receptacle which was previously slipped on the mouthpiece. Only few, particularly robust plant species can withstand the forces acting during these procedures without suffering damage.

Finally, apparatus are known which serve to fill film bags of plastics with bulk material, such as potatoes. With them, projecting edge zones of bags formed by a film web and not yet separated from one another are pulled in longitudinal direction of the film web over a spreader such that the bag edge zones which extend in longitudinal direction of the film web and are not interconnected become spread apart and are held apart until a desired amount of goods to be filled has been introduced into the bag. These known apparatus are little suitable for goods to be filled which are unwieldy and have a tendency to get stuck at the bag.

It is, therefore, the object of the invention to devise an apparatus for filling bags in such manner that it will be suitable also for packing obstinate bushy plants with rootery.

The object is met, in accordance with the invention, by an apparatus of the kind specified initially, with which the spreader means comprises a spreader tube which has the profile contour of a ship's hull and engages between projecting bag edge zones of a film web forming the bags and being movable stepwise in the longitudinal direction of this contour, the channel is upright and designed to be an immersion tube adapted at one end to plunge into the bag, and the flap is a semi-tubular portion of the channel disposed at the other end of the channel and, when in open position, acts as a conveyor chute aligning one bushy plant each in longitudinal direction of the immersion tube, with the conglomerate of roots leading.

What is achieved thereby is that the bushy plants offer only little resistance to their being moved into the immersion tube, and this resistance can be overcome either by gravity alone or by gentle help at best, using a pusher member or the like, which does not endanger the goods to be filled. Even roots or branches jutting out extraordinarily far from the bushy plants are held together in the immersion tube such that they cannot get stuck anywhere. For this reason it is warranted that each plant is introduced into the bag as far as intended and cannot tear the bag. That is particularly important with bushy plants whose conglomerate of roots for instance has been wrapped in the manner known from German utility model 88 04 853 with wire mesh which may have wire ends sticking out. Even thorny branches of bushy plants, for example rose plants, cannot get stuck at the bag while they are being introduced into the bag with the apparatus according to the invention.

The invention preferably is developed further in that an upwardly open channel opens into the conveyor chute when the latter is in the open position. Bushy plants fall in intervals one after the other into that channel. That provides preorientation of each individual bushy plant in the conveyor chute which will then be responsible only for aligning the bushy plant exactly in longitudinal direction of the immersion tube.

In general it is convenient if a plunger for pushing the bushy plants into the bag is movable back and forth in the immersion tube as in the channel of the apparatus known from U.S. Pat. No. 4,203,269. If the immersion tube is disposed sufficiently steeply, especially vertically, the goods to be filled in general will tend to slide by themselves through the immersion tube into the bag; however, the plunger described makes sure that even in case of especially unwieldy bushy plants the bottom of the bag will be reached in any case by the rootery of the plant.

Finally, it is advantageous if a holding device is arranged beyond the spreader tube in the direction of immersion to hold on to the filled bag when the immersion tube is retracted. In this manner it can be prevented positively that the immersion tube will take along, in its retraction, any especially unwieldy bushy plant.

BRIEF DESCRIPTION OF THE DRAWINGS

An embodiment of the invention will be described in greater detail below with reference to diagrammatic drawings of an assembly for packing baled bushy plants, especially rose plants. In the drawings.

DESCRIPTION OF THE PREFERRED EMBODIMENTS

Figure 1:
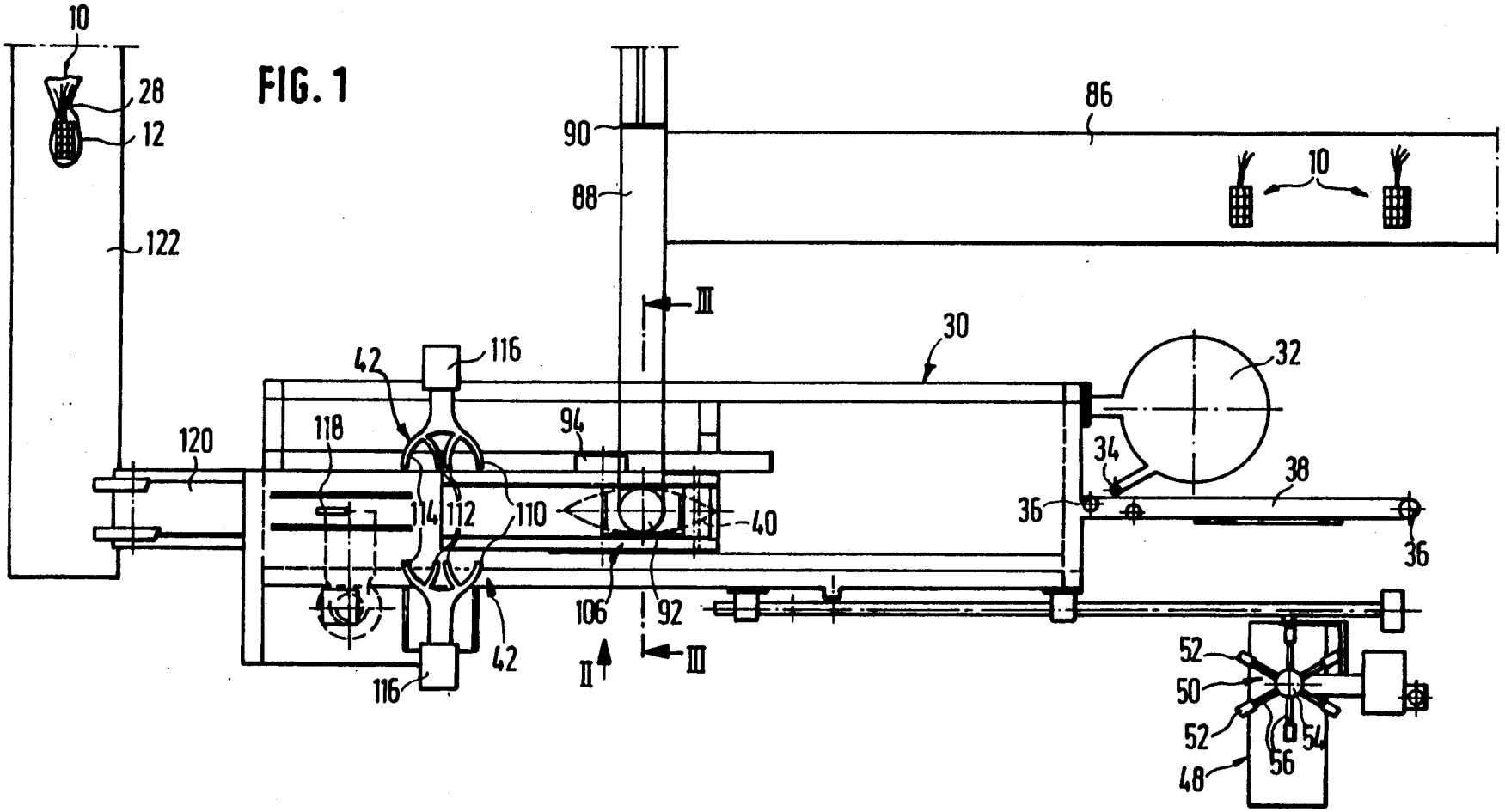
FIG. 1 shows the top plan view of the assembly.

The assembly illustrated serves for putting baled bushy plants 10 into a bag 12 each of shrinkable film and closing the bag by locally restricted shrinking in the area between shoots of the plant and the conglomerate of roots.

The bags 12, while still linked together, are formed in a tubular film web which is passed, in upright position in a vertical longitudinal plane, in horizontal direction through the assembly and is slit open at the top. The individual bags 12 are defined by vertical welding seams 14 which end below the bag upper edge zones 16 that are separated from each other by the slitting. Each bag 12 has a visible surface 18 which faces the onlooker of FIG. 2 and on which an adhesive label 20 is to be glued.

Furthermore, a binding label 22 is to be added to each bag 12. It may be attached to the plant 10 when the latter is taken out of the bag 12 at the place of planting. Each binding label 22 has an eye 24 to which a binding wire 26 is attached. The adhesive label 20 is to be glued over the binding wire 26 and, as a measure of precaution, also over the area of the eye 24 in order to fasten the binding label 22 to the bag 12. By shrinking, finally, the bag 12 is to form a neck 28; yet above and below the neck 28 the bag 12 is not to be affected by the shrinking or only relatively little.

Figure 2:
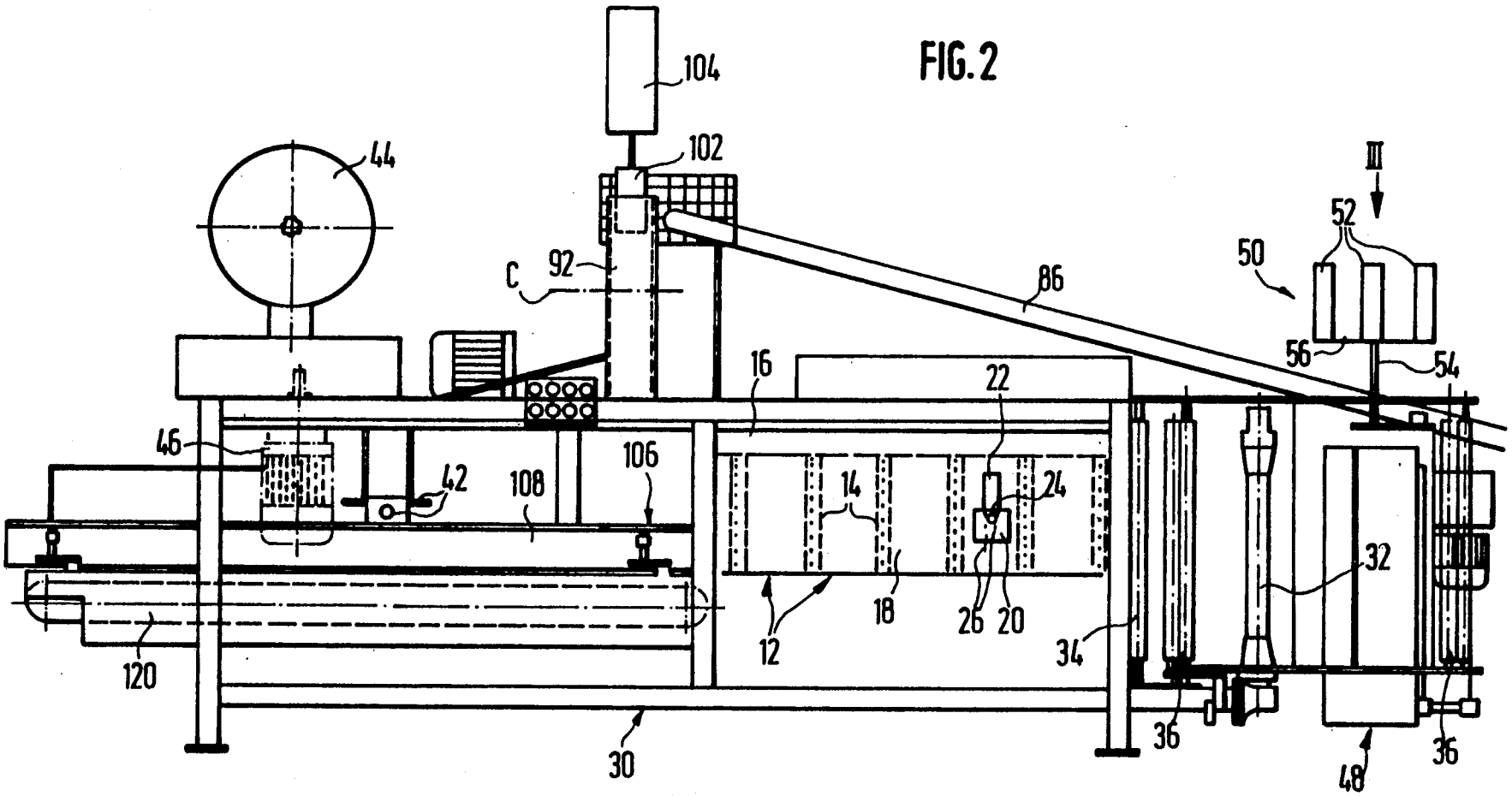
FIG. 2 is the side elevation in the direction of arrow II of FIG. 1.

The assembly shown, includes an elongated machine frame 30 at the beginning of which—at the right in FIGS. 1 and 2—a vertical pay-off reel 32 is supported for the film web in which the bags 12 are formed. Starting from the reel 32, the film web moves stepwise over a tensioning roller 34 and return rollers 36 and along a vertical support surface 38 toward a vertical tubular spreader 40 which has an elliptical cross-sectional profile, in the top plan view of FIG. 1. The spreader tube 40 enters in between the bag upper edge zones 16 and, following each conveying step of the film web, spreads them apart to such an extent above each bag 12 that the respective bag 12 opens to receive a baled plant 10. The bags 12, still interconnected but now each filled with a plant 10, subsequently pass between two groups of nozzles 42 for shrinking of their neck 28. Above the rear end of the machine frame 30—the left in FIGS. 1 and 2—there is a takeup reel 44 to wind up the bag upper edge zones 16 which were torn off from the bags 12. A common motor 46 is provided for moving the film which constitutes the bags 12 through the assembly and for rotating the take-up reel 44.

At the beginning of the assembly—at the right in FIGS. 1 and 2—there are an adhesive label dispenser 48 and above it a binding label dispenser 50. The adhesive label dispenser 48 as such is of known structure and, therefore, not shown in detail. The binding label dispenser 50, in the example shown, includes six label reservoirs 52 which are fixed to the end of an arm 56 each projecting radially away from a vertical shaft 54.

A longitudinal conveyor 86, embodied for example by a conveyor belt is provided for feeding the plants 10 which are each to be put into a bag 12. The conveyor belt rises like a ramp toward a transverse upwardly open channel 88 and lets the plants 10 drop down on the same in intervals one after the other. In the channel 88 one plant 10 each is displaceable radially in a direction toward the vertical axis B of an immersion tube 92 by a pusher member 90 which is movable back and forth for instance pneumatically.

The immersion tube 92 is arranged coaxially with the spreader tube 40 and movable up and down by a drive means 94, such as a pneumatic piston and cylinder unit, between a takeover position in which the immersion tube 92 projects from above only into the spreader tube 40 and a lower terminal position in which the immersion tube extends far down into the bag 12 held open by the spreader tube 40, if desired, almost reaching the bottom of the bag.

Figure 3:
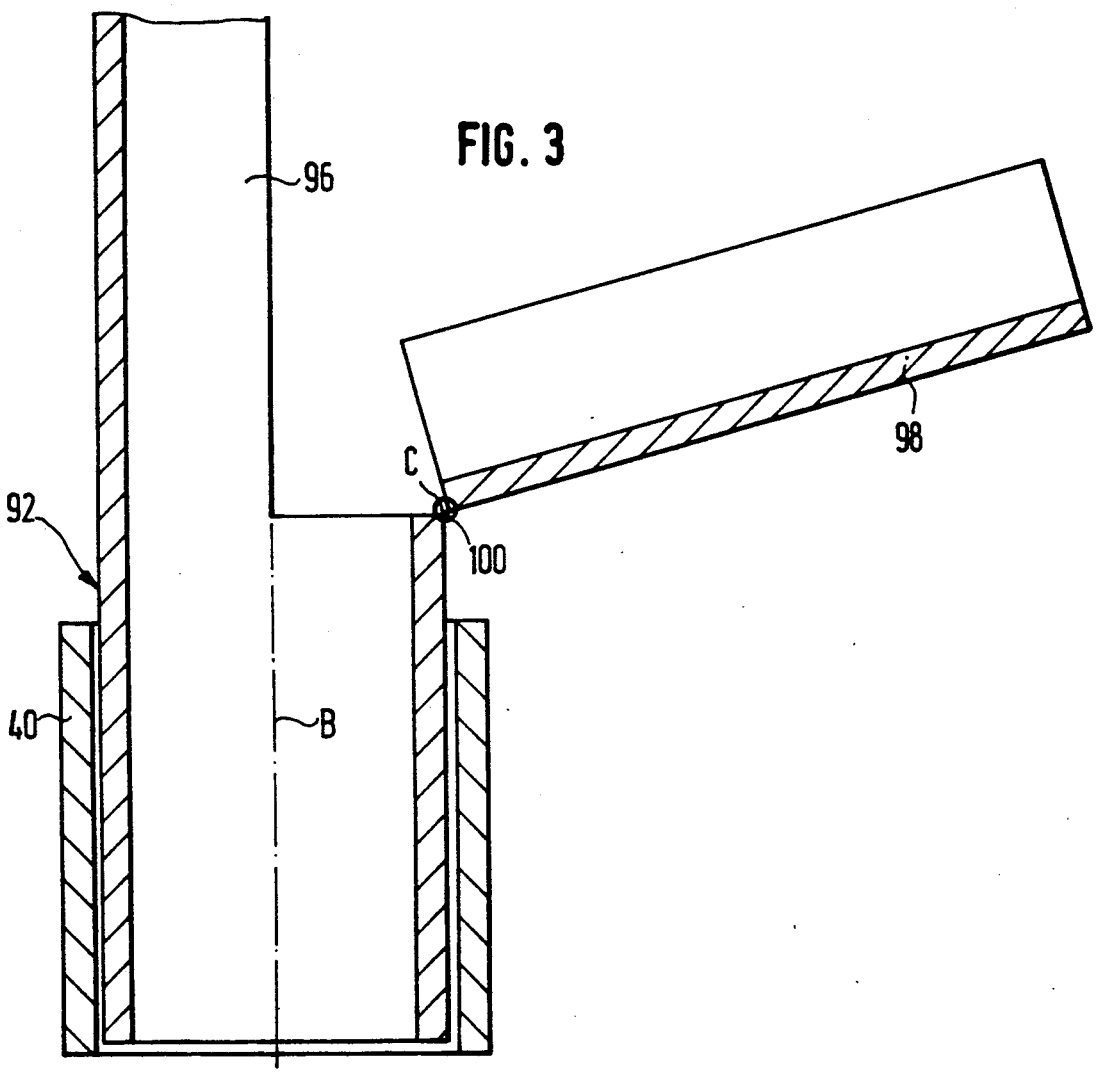
FIG. 3 is the enlarged part section III—III of FIG. 1.
Figure 4:
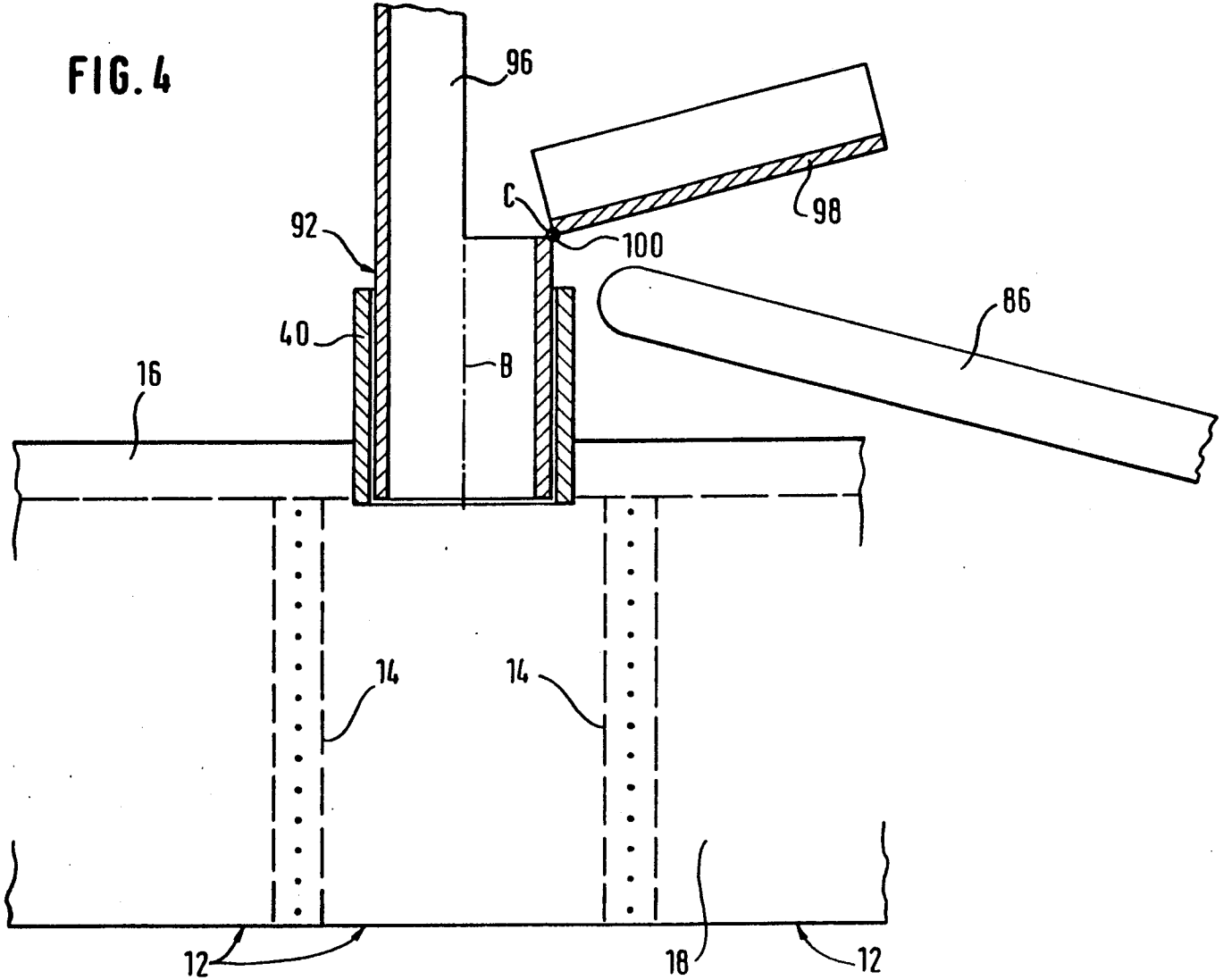
FIG. 4 shows the enlarged part section III—III of FIG. 1 and the elements relating thereto.

In its upper region, the immersion tube 92 has a semi-tubular portion 96. A conveyor chute 98 likewise semi-tubular in shape is associated with it. At its lower edge, this conveyor chute 98 is connected to the immersion tube 92 by a hinge 100 having a horizontal pivot axis C. In the takeover position, shown in FIG. 3, the conveyor chute 98 opens obliquely into the immersion tube 92 so that the latter can take over a plant 10 from the transversely disposed channel 88. The conveyor chute 98 is guided such that it supplements the semi-tubular portion 96 to form a fully closed tube section when the immersion tube 92 is lowered. The plant 10, therefore, is forced to accompany the downward movement of the immersion tube 92 and cannot but slide down in the same.

The downward sliding of the plant within the immersion tube 92 which has been closed laterally in the manner described is enhanced by forces of inertia when the downward movement of the immersion tube ends more or less abruptly. That may be sufficient to let the plant 10 slide down so far in the immersion tube 92 that the conglomerate of roots comes to rest on the bottom of the bag 12 into which the immersion tube has plunged. To make sure, however, a piston-like plunger 102 is coordinated with the immersion tube 92. It is normally held in a position of rest in the upper end region of the semi-tubular portion 96 or even above the same. The plunger 102 is connected to a piston and cylinder unit 104 which moves it in downward direction during or immediately after each lowering of the immersion tube 92 so that the plunger 102 positively will push the plant 10 down until its conglomerate of roots rests on the bottom of the bag 12.

Below the spreader tube 40 there is a holding device 106 whose task it is to hold on to the bag 12 and the plant 10 put inside it, preferably holding it by its conglomerate of roots, while the immersion tube 92 is moved up again into its takeover position. In the embodiment shown, the holding device 106 has a pair of jaws 108 which are movable toward and away from each other pneumatically for instance.

As soon as the immersion tube 92 has been withdrawn from the bag 12 just filled, the entire film web in which the bags are formed is advanced one step. Hereby the left edge in FIGS. 1 and 2 of the bag that has just been filled gets into the range of influence of one each of the front nozzles 110 of the two groups of nozzles 42 so that the hot air emanating from them begins to cause the neck 28 to shrink. After the next conveying step the bag 12 in question is located exactly between two pairs of central nozzles 112; the hot air flowing out of them continues the shrinking at the neck 28 more intensively. After another conveying step the right edge area in FIGS. 1 and 2 of the neck 28 is positioned between rear nozzles 114 of the two groups of nozzles 42 so that the shrinking which is concentrated on the neck 28 is completed.

The two groups of nozzles 42 are supplied with hot air from a blower 116 each whenever a bag 12 has reached their range of influence. Careful thermal insulation of the nozzle groups 42 prevents undue cooling during the intervals when the blowers 116 are at standstill.

Downstream of the groups of nozzles 42 the bag edge zones 16 are torn off from the film web which has been perforated or otherwise prepared accordingly and are wound up by the take-up reel 44. At the same time or immediately afterwards the bags which have been filled and shrunk at their necks 28 are separated from one another by a severing means 118 and moved on by a longitudinal conveyor 120 and finally by a transverse conveyor 122.

What is claimed is:

1. An apparatus for filling bags with unwieldy goods, comprising:

(a) means for providing a plurality of individual bags (12) for filling with unwieldy goods, comprising a plurality of individual bags (12) linked together in a tubular film web capable of stepwise movement in upright position in a vertical longitudinal plane and having projecting bag edge zones (16), with each bag (12) interconnected by vertical welding seams (14) and having an open upper end and an interior portion;

(b) means for spreading open the individual bags (12), comprising a spreader tube (40) having an open interior portion and an elliptical cross-sectional profile, wherein the spreader tube (40) engages between projecting bag edge zones (16) of the individual bag (12); and (c) means for channeling the goods into the individual bags (12), comprising an immersion tube (92) coaxially arranged along the interior portion of spreader tube (40) and having an open interior portion, a lower portion adapted to project into the individual bag (12), and an upper portion adapted to receive the goods, drive means (94) interconnected to said immersion tube (92) capable of moving the immersion tube (92) between a first position wherein goods are introduced into the channeling means and a second position in which the immersion tube (92) projects through the interior portion of spreader tube (40) into the interior portion of the individual bag (12), the upper portion of said immersion tube (92) further comprising a conveyor chute (98) which is a semi-tubular flap, hinge means (100) connecting said conveyor chute (98) to said lower portion of the immersion tube (92) for moving said conveyor chute (98) between an open position wherein the goods are received by the channeling means when the immersion tube (92) is in the first position and a closed position wherein the conveyor chute (98) forms a portion of the immersion tube (92) when the immersion tube (92) is in the second position.

2. An apparatus according to claim 1, in which the channeling means further comprise an upwardly open channel (88) which adjoins the open position of the conveyor chute (98), thereby enabling bushy plants (10) to periodically be conveyed from a conveyor (86) to the channeling means.

3. An apparatus according to either claim 1 or claim 2, further comprising a plunger (102) adapted to move longitudinally along the open interior portion of the immersion tube (92) to impart movement to the goods channeled through the immersion tube (92) into individual bags (12).

4. An apparatus according to claim 3, further comprising a holding device (106) positioned below the individual bag (12) to retain the bag (12) after the immersion tube (92) retracts to the first position and the bag (12) contains the goods.

* * * * *